US008677756B2

(12) United States Patent
Poyyapakkam et al.

(10) Patent No.: US 8,677,756 B2
(45) Date of Patent: Mar. 25, 2014

(54) REHEAT BURNER INJECTION SYSTEM

(75) Inventors: Madhavan Poyyapakkam, Rotkreuz (CH); Anton Winkler, Olching (DE); Khawar Syed, Oberrohrdoff (CH); Adnan Eroglu, Untersiggenthal (CH); Andrea Ciani, Zürich (CH)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 13/465,752

(22) Filed: May 7, 2012

(65) Prior Publication Data

US 2012/0260622 A1 Oct. 18, 2012

Related U.S. Application Data

(63) Continuation of application No. PCT/EP2010/066395, filed on Oct. 28, 2010.

(30) Foreign Application Priority Data

Nov. 7, 2009 (CH) ..... 1886/09

(51) Int. Cl.
*F02C 1/00* (2006.01)
*F02G 3/00* (2006.01)

(52) U.S. Cl.
USPC ..... 60/740; 60/742; 239/403

(58) Field of Classification Search
USPC ..... 60/748, 742, 740, 39.463, 761, 763, 60/765, 804, 239, 402, 403; 239/402, 403
See application file for complete search history.

(56) References Cited

U.S. PATENT DOCUMENTS 580,360 A 4/1897 Bachy
2,478,851 A 8/1949 Traupel
(Continued)

FOREIGN PATENT DOCUMENTS

EP 0 473 371 A1 3/1992
EP 0 911 585 A1 4/1999
(Continued)

OTHER PUBLICATIONS

Cumpsty "Jet Propulsion: A Simple Guide to the Aerodynamic and Thermodynamic Design and Performance of Jet Engines" 2003 second edition Cambridge University Press p. 229.*

(Continued)

*Primary Examiner* — Gerald L Sung
*Assistant Examiner* — William Breazeal
(74) *Attorney, Agent, or Firm* — Buchanan Ingersoll & Rooney PC

(57) ABSTRACT

A burner, such as for a secondary combustion chamber of a gas turbine with sequential combustion having first and second combustion chambers, includes an injection device for introducing at least one gaseous fuel into the burner. The injection device has at least one body which is arranged in the burner with at least one nozzle for introducing the gaseous fuel into the burner. The body is configured as a streamlined body which has a streamlined cross-sectional profile and which extends with a longitudinal direction perpendicularly or at an inclination to a main flow direction prevailing in the burner. The at least one nozzle has its outlet orifice at or in a trailing edge of the streamlined body. The body has two lateral surfaces substantially parallel to the main flow direction. At least one vortex generator is located on at least one lateral surface upstream of the at least one nozzle.

20 Claims, 8 Drawing Sheets

(56) References Cited

U.S. PATENT DOCUMENTS

| | | | | |
|---|---|---|---|---|
| 2,944,388 | A | 7/1960 | Bayer | |
| 3,373,567 | A | 3/1968 | Palfreyman et al. | |
| 3,620,012 | A | 11/1971 | Wilde | |
| 4,830,315 | A | 5/1989 | Presz, Jr. et al. | |
| 4,887,425 | A | 12/1989 | Vdoviak | |
| 4,932,861 | A | 6/1990 | Keller et al. | |
| 5,203,796 | A | 4/1993 | Washam et al. | |
| 5,235,813 | A | 8/1993 | McVey et al. | |
| 5,251,447 | A | 10/1993 | Joshi et al. | |
| 5,297,391 | A | 3/1994 | Roche | |
| 5,315,815 | A | 5/1994 | McVey et al. | |
| 5,351,477 | A | 10/1994 | Joshi et al. | |
| 5,423,608 | A | 6/1995 | Chyou et al. | |
| 5,431,018 | A | 7/1995 | Keller et al. | |
| 5,433,596 | A | 7/1995 | Dobbeling et al. | |
| 5,487,659 | A | 1/1996 | Eroglu et al. | |
| 5,511,375 | A | 4/1996 | Joshi et al. | |
| 5,513,982 | A | 5/1996 | Althaus et al. | |
| 5,593,302 | A | 1/1997 | Althaus et al. | |
| 5,622,054 | A | 4/1997 | Tingle | |
| 5,626,017 | A | 5/1997 | Sattelmayer | |
| 5,638,682 | A | 6/1997 | Joshi et al. | |
| 5,647,200 | A * | 7/1997 | Althaus | 60/39.17 |
| 5,685,140 | A | 11/1997 | Clements et al. | |
| 5,735,126 | A * | 4/1998 | Schulte-Werning | 60/732 |
| 5,794,449 | A | 8/1998 | Razdan et al. | |
| 5,803,602 | A | 9/1998 | Eroglu et al. | |
| 5,813,232 | A | 9/1998 | Razdan et al. | |
| 5,865,024 | A | 2/1999 | Kress et al. | |
| 5,941,064 | A | 8/1999 | Chevalier et al. | |
| 6,082,111 | A | 7/2000 | Stokes | |
| 6,112,516 | A | 9/2000 | Beule et al. | |
| 6,263,660 | B1 | 7/2001 | Lawlor | |
| 6,357,237 | B1 * | 3/2002 | Candy et al. | 60/737 |
| 6,460,326 | B2 | 10/2002 | Bechtel et al. | |
| 6,786,430 | B2 | 9/2004 | Hayashi | |
| 6,795,192 | B2 | 9/2004 | Dickopf et al. | |
| 8,047,001 | B2 | 11/2011 | Beeck et al. | |
| 2002/0038542 | A1 | 4/2002 | Akama et al. | |
| 2002/0187448 | A1 | 12/2002 | Eroglu et al. | |
| 2003/0128364 | A1 | 7/2003 | Dickopf et al. | |
| 2006/0016192 | A1 | 1/2006 | Bunel et al. | |
| 2006/0230764 | A1 | 10/2006 | Schmotolocha et al. | |
| 2007/0033945 | A1 | 2/2007 | Goldmeer et al. | |
| 2007/0151250 | A1 | 7/2007 | Haynes | |
| 2008/0078182 | A1 | 4/2008 | Evulet | |
| 2009/0081048 | A1 | 3/2009 | Beeck et al. | |
| 2010/0300109 | A1 | 12/2010 | Carroni et al. | |

FOREIGN PATENT DOCUMENTS

| | | | |
|---|---|---|---|
| EP | 1 434 007 | A2 | 6/2004 |
| EP | 1 619 441 | A1 | 1/2006 |
| EP | 1 752 709 | A2 | 2/2007 |
| EP | 1 257 809 | B1 | 10/2007 |
| EP | 1 847 696 | A1 | 10/2007 |
| EP | 2 072 899 | A1 | 6/2009 |
| GB | 2 216 999 | A1 | 10/1989 |
| GB | 2 293 001 | A | 3/1996 |
| JP | 54-121425 | A | 9/1979 |
| WO | WO 00/19081 | A2 | 4/2000 |
| WO | 2009019113 | A2 | 2/2009 |
| WO | 2009/080600 | A1 | 7/2009 |

OTHER PUBLICATIONS

Morris, Analyses for Turbojet Thrust Augmentation with Fuel-Rich Afterburning of Hydrogen, Diborane, and Hydrazine, National Advisory Commitee for Aeronautics, 1957, p. 1.*

Lundin, Summary of NACA Research on Afterburners for Turbojet Engines, 1956, p. 20.*

Flack, Fundamentals of Jet Propulsion with Applications, 2005, Cambridge Press, p. 19.*

International Search Report (PCT/ISA/210) issued on Jul. 14, 2011, by the European Patent Office as the International Searching Authority for International Application No. PCT/EP2010/066497.

Written Opinion (PCT/ISA/237) issued on Jul. 14, 2011, by the European Patent Office as the International Searching Authority for International Application No. PCT/EP2010/066497.

Swiss Search Report issued on May 12, 2010 for Swiss Application No. 1887/2009.

International Search Report (PCT/ISA/210) issued on Jun. 4, 2011, by the European Patent Office as the International Searching Authority for International Application No. PCT/EP2010/066513.

Written Opinion (PCT/ISA/237) issued on Jun. 4, 2011, by the European Patent Office as the International Searching Authority for International Application No. PCT/ EP2010/066513.

Swiss Search Report issued on May 12, 2010 for Swiss Application No. 1888/2009.

International Search Report (PCT/ISA/210) issued on Jul. 14, 2011, by the European Patent Office as the International Searching Authority for International Application No. PCT/EP2010/066395.

Written Opinion (PCT/ISA/237) issued on Jul. 14, 2011, by the European Patent Office as the International Searching Authority for International Application No. PCT/ EP2010/066395.

Swiss Search Report issued on May 12, 2010 for Swiss Application No. 1886/2009.

International Search Report (PCT/ISA/210) issued on Jan. 20, 2011, by the European Patent Office as the International Searching Authority for International Application No. PCT/EP2010/066522.

Written Opinion (PCT/ISA/237) issued on Jul. 14, 2011, by the European Patent Office as the International Searching Authority for International Application No. PCT/EP2010/066522.

Swiss Search Report issued on Apr. 7, 2010 for Swiss Application No. 1889/2009.

International Search Report (PCT/ISA/210) issued on Jan. 20, 2011, by the European Patent Office as the International Searching Authority for International Application No. PCT/EP2010/066535.

Written Opinion (PCT/ISA/237) issued on Jan. 20, 2011, by the European Patent Office as the International Searching Authority for International Application No. PCT/ EP2010/066535.

Swiss Search Report issued on Apr. 6, 2010 for Swiss Application No. 1890/2009.

Office Action dated Aug. 30, 2013 issued by the USPTO in corresponding U.S. Appl. No. 13/465,544.

* cited by examiner

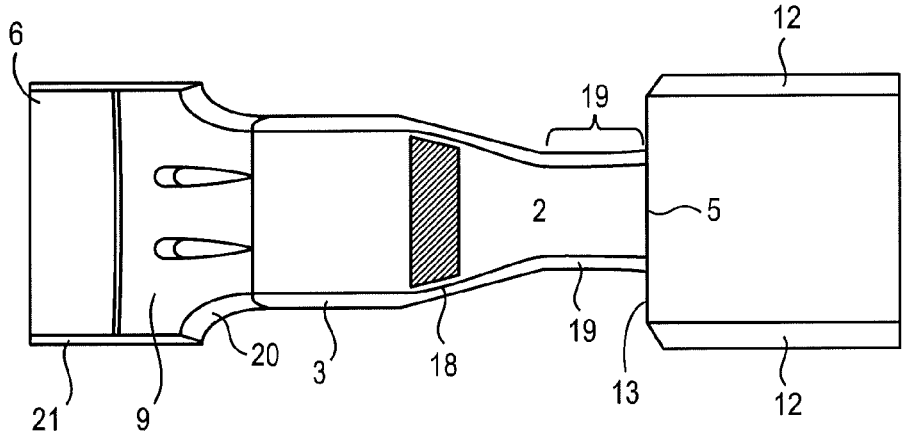
FIG. 3
FIG. 4
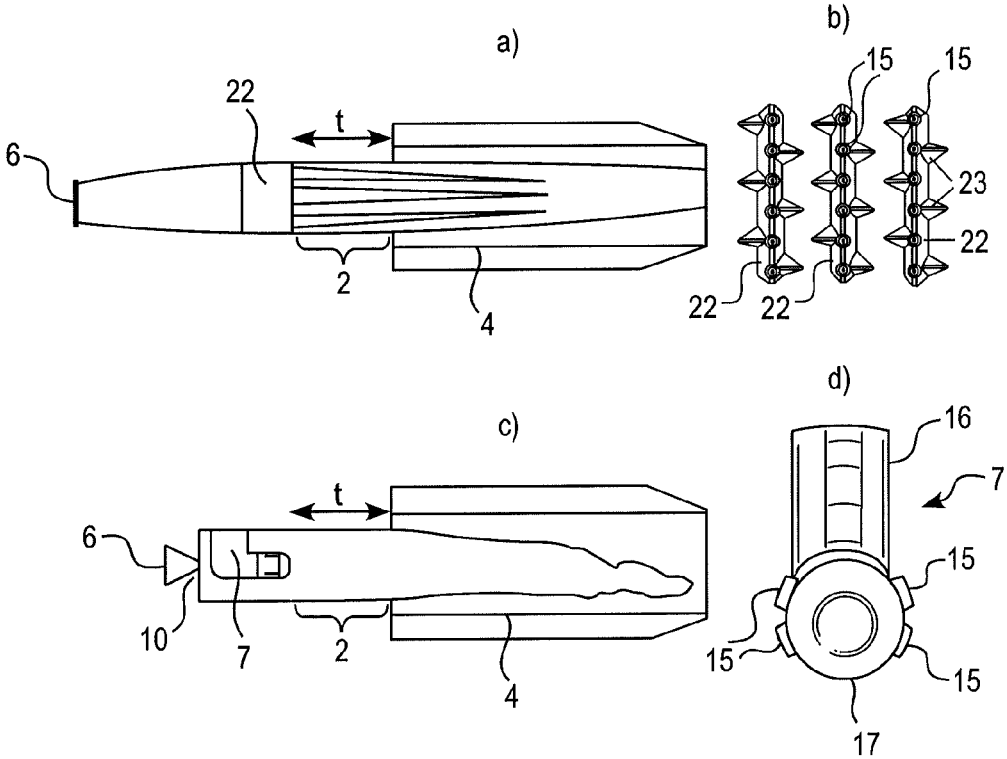

REHEAT BURNER INJECTION SYSTEM

RELATED APPLICATION(S)

This application claims priority as a continuation application under 35 U.S.C. §120 to PCT/EP2010/066395, which was filed as an International Application on Oct. 28, 2010 designating the U.S., and which claims priority to Swiss Application 01886/09 filed in Switzerland on Nov. 7, 2009. The entire contents of these applications are hereby incorporated by reference in their entireties.

FIELD

A burner is disclosed for a secondary combustion chamber of a gas turbine with sequential combustion having a first and a secondary combustion chamber, with an injection device for the introduction of at least one gaseous fuel into the burner.

BACKGROUND INFORMATION

In order to increase efficiency, a high turbine inlet temperature is used in standard gas turbines. As a result, there can arise high NOx emission levels and higher life cycle costs. These can be mitigated with a sequential combustion cycle, wherein the compressor delivers an increased pressure ratio. A main flow passes a first combustion chamber (for example, using a known burner of the type as disclosed in EP 1 257 809 or as in U.S. Pat. No. 4,932,861, also called an EV combustor, where the EV stands for environmental), wherein a part of the fuel is combusted. After expanding at a high-pressure turbine stage, the remaining fuel is added and combusted (for example, using a burner of the type as disclosed in U.S. Pat. No. 5,431,018 or U.S. Pat. No. 5,626,017 or in U.S. Patent Application Publication No. 2002/0187448, also called SEV combustor, where the S stands for sequential). Both combustors contain premixing burners, to lower NOx emissions.

Because the second combustor is fed by expanded exhaust gas of the first combustor, the operating conditions can allow self ignition (spontaneous ignition) of the fuel air mixture without additional energy being supplied to the mixture. To prevent ignition of the fuel air mixture in the mixing region, the residence time therein should not exceed the auto ignition delay time. This criterion can allow flame-free zones inside the burner but can pose challenges in obtaining appropriate distribution of the fuel across the burner exit area.

SEV-burners can be designed for operation on natural gas and oil. Therefore, the momentum flux of the fuel can be adjusted relative to the momentum flux of the main flow so as to penetrate in to the vortices. The subsequent mixing of the fuel and the oxidizer at an exit of the mixing zone can be just sufficient to allow relatively low NOx emissions (mixing quality) and avoid flashback (residence time), which may be caused by auto ignition of the fuel air mixture in the mixing zone.

SUMMARY

A burner for a combustion chamber of a gas turbine is disclosed, comprising: an injection device for introducing at least one gaseous fuel into the burner, the injection device comprising: at least one body arranged in the burner and configured as a streamlined body which has a streamlined cross-sectional profile and which extends with a longitudinal direction perpendicularly or at an inclination to a main flow direction prevailing in the burner and two lateral surfaces; at least one nozzle for introducing the at least one gaseous fuel into the burner, the at least one nozzle having an outlet orifice at or in a trailing edge of the streamlined body, and at least one vortex generator located upstream of the at least one nozzle on at least one lateral surface.

BRIEF DESCRIPTION OF THE DRAWINGS

Exemplary embodiments of the disclosure are described in the following with reference to the drawings, which are for the purpose of illustrating the exemplary embodiments of the disclosure and not for the purpose of limiting the same. In the drawings:

FIG. 3 shows an exemplary embodiment according to the disclosure of a secondary burner located downstream of the high-pressure turbine with a reduced exit cross-section area;

FIG. 4 shows in a) a schematic representation of a burner according to an exemplary embodiment of the disclosure with contours indicating burner residence times, in b) the injection devices for the burner according to a) in a view opposite to a direction of flow of oxidising medium, in c) a schematic representation of a burner with a fuel lance, as a streamlined body with shadings indicating burner residence times, and in d) the fuel lance in a view opposite to the direction of the flow of oxidising medium for the burner according to c);

DETAILED DESCRIPTION

Figure 1:
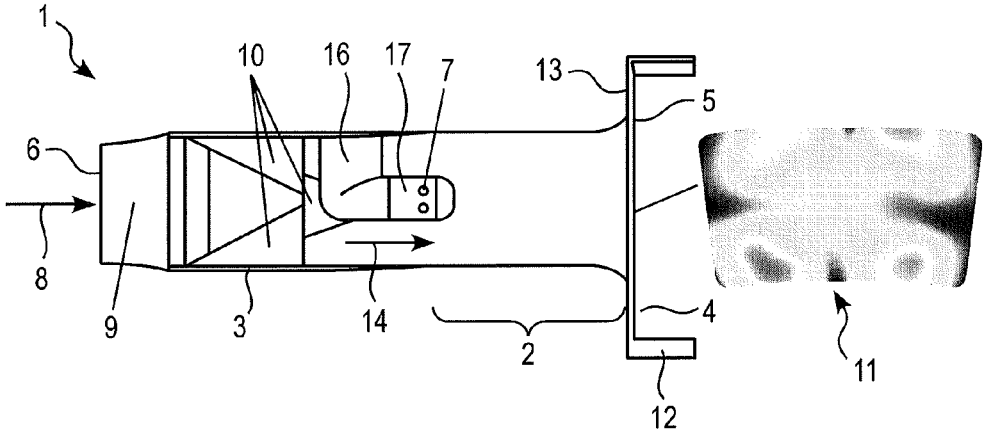
FIG. 1 PRIOR ART
FIG. 1 shows a secondary burner located downstream of a high-pressure turbine together with a fuel mass fraction contour (left side) at an exit of the burner.

Exemplary embodiments of the present disclosure provide an improved burner for example, for high reactivity conditions, i.e. either for a situation where the inlet temperature of a secondary burner is higher than reference, and/or for a situation where high reactivity fuels, specifically MBtu fuels, shall be burned in such a secondary burner.

A burner, according to an exemplary embodiment of the disclosure can be provided for a secondary combustion chamber of a gas turbine with sequential combustion having a first and a second combustion chamber, with an injection device for the introduction of at least one gaseous fuel into the burner. The injection device of this burner can have at least one body or lance which is arranged in the burner and wherein this body has at least one nozzle for introducing the at least one gaseous fuel into the burner. The at least one body can be configured as a streamlined body which has a streamlined cross-sectional profile and which extends with a longitudinal direction perpendicularly to or at an inclination to a main flow direction prevailing in the burner. The at least one nozzle has its outlet orifice at or in a trailing edge of the streamlined body. The body in accordance with an exemplary embodiment of the disclosure can have two lateral surfaces (at least for one central body substantially parallel to the main flow direction and converging, i.e. inclined for the others), and upstream of the at least one nozzle on at least one lateral surface there is located at least one vortex generator.

An exemplary embodiment of the disclosure can merge a vortex generator aspect and a fuel injection device (separate structural vortex generator element upstream of separate fuel injection device) into one single combined vortex generation and fuel injection device. By doing this, mixing of fuels with oxidation air and vortex generation take place in a relatively close spatial vicinity and relatively efficiently, such that more rapid mixing is possible and the length of the mixing zone can be reduced. It is even possible in some cases, by corresponding design and orientation of the body in the oxidising air path, to omit the flow conditioning elements (turbine outlet guide vanes) as the body can also take over the flow conditioning. All this can be possible without severe pressure drop along the injection device such that the overall efficiency of the process can be maintained.

In one burner at least one, two or three such injection devices can be located.

Upstream of the body and downstream of the row of rotating blades, or, in case of several rows, of a last row of rotating blades of the high-pressure turbine, there can be no additional vortex generators, and also no additional flow conditioning elements.

According to an exemplary embodiment of the disclosure, downstream of the body or lance, a mixing zone is located, and wherein at and/or downstream of the body, the cross-section of the mixing zone is reduced (normally by conical convergence). This reduction in cross-section can be, for example, at least 10%, (e.g., at least 20% or at least 30% or at least 40%) compared to the flow cross-section upstream of the body. By having such a reduced cross-section the main flow velocity can be increased making it possible to use high reactivity fuels or to apply high inlet temperatures as the residence time in the mixing section is reduced.

In order to have a sufficiently efficient vortex generation to produce higher circulation rates at a minimum pressure drop, the vortex generator can have an attack angle in the range of 15-20° and/or a sweep angle in the range of 55-65°.

Generally speaking, vortex generators, for example, as are disclosed in U.S. Pat. No. 5,803,602 and U.S. Pat. No. 5,423,608 can be used in the present context, the disclosure of these two documents being specifically incorporated into this disclosure by reference.

At least two nozzles (for example, at least four, or six) can be arranged at different positions along the trailing edge (in a row with spacings in between), wherein upstream of each of these nozzles at least one vortex generator is located.

It is possible to have two vortex generators on opposite sides of the body for one nozzle or for a pair of nozzles.

Generally "upstream" in the context of the vortex generators relative to the nozzles can mean that the vortex generator generates a vortex at the position of the nozzle.

The vortex generators can also be facing upstream in order to bring the vortices closer to the fuel injection location.

Vortex generators to adjacent nozzles (along the row) are located at opposite lateral surfaces of the body. In exemplary embodiments according to the disclosure, more than three, for example four, nozzles can be arranged along the trailing edge and vortex generators can be alternatingly located at the two lateral surfaces.

It is possible to have at least one nozzle injecting fuel and/or carrier gas parallel to the main flow direction. This can allow higher reactivity conditions as the fuel is carried downstream relatively rapidly and can allow use of relatively low pressure carrier gas.

It is also possible that at least one nozzle injects fuel and/or carrier gas at an inclination angle between 0-30° with respect to the main flow direction.

In an exemplary embodiment according to the disclosure downstream of each vortex generator there can be located at least two nozzles for fuel injection at the trailing edge.

In an exemplary embodiment according to the disclosure the streamlined body can extend across the entire flow cross section between opposite walls of the burner.

The burner can be an annular burner arranged circumferentially with respect to a turbine axis. In this case between 10-100 such streamlined bodies for combined vortex generation and fuel injection, (for example, between 40-80 streamlined bodies), can be arranged around the circumference of the annular combustion chamber. All of them can be equally distributed along the circumference of the combustion chamber.

The profile of the streamlined body can be parallel to the main flow direction. It can also be inclined with respect to the main flow direction at least over a certain part of its longitudinal extension. For example, the profile of the streamlined body can be rotated or twisted, for example, in opposing directions relative to the longitudinal axis on both sides of a longitudinal midpoint, in order to impose a mild swirl on the main flow.

The vortex generator(s) can also be provided with cooling elements. These cooling elements can be effusion/film cooling holes provided in at least one of the surfaces of the vortex generator. Also possible is internal cooling such as impingement cooling. The film cooling holes can be fed with air from the carrier gas feed also used for the fuel injection to simplify the setup. Due to the in-line injection of the fuel, lower pressure carrier gas can be used, so the same gas supply can be used for fuel injection and cooling.

The body can be provided with cooling elements. These cooling elements can be provided as internal circulation of cooling medium along the sidewalls of the body and/or by film cooling holes, located near the trailing edge. Also possible is impingement cooling. The cooling elements can be fed with air from the carrier gas feed also used for the fuel injection.

As mentioned above, the fuel can be injected from the nozzle together with a carrier gas stream (the fuel can be injected centrally and a carrier gas circumferentially encloses the fuel jet), wherein the carrier gas air is low pressure air with a pressure in the range of about 10-20 bar (±10%), for example, in the range of about 16-20 bar (±10%). As in-line injection is used, a lower pressure can be used for the carrier gas.

The streamlined body can have a symmetric cross-sectional profile, i.e. one which is mirror symmetric with respect to the central plane of the body.

The streamlined body can also be arranged centrally in the burner with respect to a width of a flow cross section.

The streamlined body can be arranged in the burner such that a straight line connecting the trailing edge to a leading edge extends parallel to the main flow direction of the burner.

A plurality of separate outlet orifices of a plurality of nozzles can be arranged next to one another and arranged at the trailing edge.

At least one slit-shaped outlet orifice can be, in the sense of a nozzle, arranged at the trailing edge.

Exemplary embodiments of the present disclosure relate to the use of a burner as defined above for the combustion under high reactivity conditions. For example, for the combustion at high burner inlet temperatures and/or for the combustion of MBtu fuel, normally with a calorific value of about 5000-20,000 kJ/kg, (e.g., about 7000-17,000 kJ/kg, and about 10,000-15,000 kJ/kg) and for example, such a fuel including hydrogen gas.

In an exemplary embodiment according to the disclosure several design modifications to a known secondary burner (SEV) can introduce a low pressure drop complemented by rapid mixing for highly reactive fuels and operating conditions, to provide fuel-air mixing within short burner-mixing lengths. Exemplary embodiments of the disclosure include aerodynamically facilitated axial fuel injection with mixing promoted by relatively small sized vortex generators, eliminate/replace high-pressure and relatively more expensive carrier air with low pressure carrier air. As a result, the burner can operate at increased SEV inlet temperature or fuel flexibility without suffering on high NOx emissions or flashback.

According to an exemplary embodiment of the disclosure, advantages can include:

Relatively higher burner velocities can accommodate highly reactive fuels;

Relatively lower burner pressure drop for similar mixing levels;

SEV can operate at higher inlet temperatures; and

High-pressure carrier air with low pressure carrier air can be removed or replaced with low pressure carrier air.

With respect to performing fuel air mixing, the following components of current burner systems should be considered.

At the entrance of the SEV combustor, the main flow should be conditioned in order to provide uniform inflow conditions independent of the upstream disturbances, for example, those caused by the high-pressure turbine stage.

Then, the flow should pass four vortex generators.

For the injection of gaseous and liquid fuels into the vortices, fuel lances can be used, which extend into the mixing section of the burner and inject the fuel(s) into the vortices of the air flowing around the fuel lance.

To this end FIG. 1 shows a known secondary burner 1. The burner, which is an annular burner, is bordered by opposite walls 3. These opposite walls 3 define the flow space for the flow 14 of oxidizing medium. This flow enters as a main flow 8 from the high pressure turbine, i.e. behind the last row of rotating blades of the high pressure turbine which is located downstream of the first combustor. This main flow 8 enters the burner at the inlet side 6. First this main flow 8 passes flow conditioning elements 9, which can be turbine outlet guide vanes which are stationary and bring the flow into the proper orientation. Downstream of these flow conditioning elements 9, vortex generators 10 are located in order to prepare for the subsequent mixing step. Downstream of the vortex generators 10 there is provided an injection device or fuel lance 7 which can include a stem or foot 16 and an axial shaft 17. At the most downstream portion of the shaft 17 fuel injection takes place. In this case fuel injection can take place via orifices which inject the fuel in a direction perpendicular to flow direction 14 (cross flow injection).

Downstream of the fuel lance 7 there is the mixing zone 2, in which the air, bordered by the two walls 3, mixes with the fuel and then at the outlet side 5 exits into the combustion chamber or combustion space 4 where self-ignition takes place.

At the transition between the mixing zone 2 to the combustion space 4 there can be a transition 13, which may be in the form of a step, or as indicated here, can be provided with round edges and also with stall elements for the flow. The combustion space is bordered by the combustion chamber wall 12.

This leads to a fuel mass fraction contour 11 at the burner exit 5 as indicated on the right side of FIG. 1.

Figure 2:
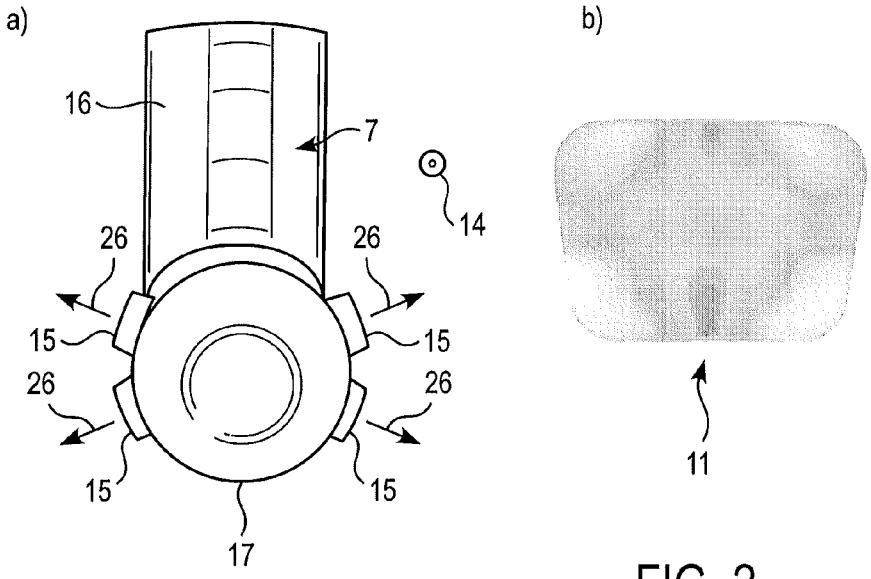
FIG. 2 shows a secondary burner fuel lance in a view opposite to the direction of the flow of oxidising medium in a) and the fuel mass fraction contour using such a fuel lance at the exit of the burner in b)

In FIG. 2, a second fuel injection is illustrated. Here the fuel lance 7 is not provided with known injection orifices but in addition to their positioning at specific axial and circumferential positions has circular sleeves protruding from the cylindrical outer surface of the shaft 17 such that the injection of the fuel along injection direction 26 can be relatively more efficient as the fuel can be more efficiently directed into the vortices generated by the vortex generators 10.

Using a set up according to FIG. 2*a* the fuel mass fraction contour according to FIG. 2*b* can result.

SEV-burners can be designed for operation on natural gas and oil. Therefore, the momentum of the fuel is adjusted relative to the momentum of the main flow so as to penetrate in to the vortices. The subsequent mixing of the fuel and the oxidizer at the exit of the mixing zone can be just sufficient to allow low NOx emissions (mixing quality) and avoid flashback (residence time), which can be caused by auto ignition of the fuel air mixture in the mixing zone.

Exemplary embodiments of the present disclosure relate to burning of fuel air mixtures with a reduced ignition delay time. This can be achieved by an integrated approach, which allows higher velocities of the main flow and in turn, a lower residence time of the fuel air mixture in the mixing zone. The challenge regarding the fuel injection is twofold with respect to the use of hydrogen rich fuels and fuel air mixtures with high temperatures:

Hydrogen rich fuels can change the penetration behavior of the fuel jets. The penetration can be determined by the cross section areas of the burner and the fuel injection holes, respectively.

The second issue is that depending on the type of fuel or the temperature of the fuel air mixture, the reactivity, which can be defined as tign,ref/tign, i.e. as the ratio of the ignition time of reference natural gas to the ignition time as actually valid, of the fuel air mixture changes.

The conditions to which exemplary embodiments of the present disclosure addresses are those where the reactivity as defined above is above 1 and the flames are auto igniting. Exemplary embodiments of the disclosure are however not limited to these conditions.

For each temperature and mixture composition the laminar flame speed and the ignition delay time can change. As a result, hardware configurations should be provided offering a suitable operation window. For each hardware configuration, the upper limit regarding the fuel air reactivity can be given by the flashback safety.

In the framework of an SEV burner the flashback risk is increased, as the residence time in the mixing zone exceeds the ignition delay time of the fuel air. Mitigation can be achieved in several different ways.

The inclination angle of the fuel can be adjusted to decrease the residence time of the fuel. Herein, various possibilities regarding the design may be considered, for example, inline fuel injection, i.e. substantially parallel to the oxidizing airflow, a conical lance shape or a horny lance design.

The reactivity can be slowed down by diluting the fuel air mixture with nitrogen or steam, respectively.

De-rating of the first stage can lead to less aggressive inlet conditions for the SEV burner in case of highly reactive fuels. In turn, the efficiency of the overall gas turbine can decrease.

The length of the mixing zone can be kept constant, if in turn the main flow velocity is increased. However, then normally a penalty on the pressure drop must be taken.

By implementing more rapid mixing of the fuel and the oxidizer, the length of the mixing zone can be reduced while maintaining the main flow velocity.

Exemplary embodiments of the disclosure can evolve an improved burner configuration, wherein the latter two points are addressed, which however can be combined also with the upper three points.

In order to allow capability for highly reactive fuels, the injector can perform flow conditioning (at least partial), injection and mixing simultaneously. As a result, the injector can save burner pressure loss, which is currently utilized in the various devices along the flow path. If the combination of flow conditioning device, vortex generator and injector is replaced by the exemplary embodiments according to the disclosure, the velocity of the main flow can be increased in order to achieve a short residence time of the fuel air mixture in the mixing zone.

FIG. 3 shows a set-up, where the proposed burner area is relatively reduced. The higher burner velocities help in operating the burner safely at highly reactive conditions. In FIG. 3 a burner is shown with reduced exit cross-section area. In this case downstream of the inlet side 6 of the burner there is located a flow conditioning element or a row of flow conditioning elements 9 but in this case not followed by vortex generators but then directly followed with a fuel injection device according to an exemplary embodiment of the disclosure, which is given as a streamlined body 22 extending with its longitudinal direction across the two opposite walls 3 of the burner. At the position where the streamlined body 22 is located, the two walls 3 converge in a converging portion 18 and narrow down to a reduced burner cross-sectional area 19. This defines the mixing space 2 which ends at the outlet side 5 where the mixture of fuel and air enters the combustion chamber or combustion space 4 which is delimited by walls 12.

FIG. 4 shows examples of the residence times for the inline injection concept (in a using a device according to b) lowered by 40% when compared to a known cross flow injection concept (in c using a device according to d, i.e. according to FIG. 2). The residence time t in case of the setup according to exemplary embodiments of the disclosure of (a) is smaller than according to the setup according to c and d.

Several more exemplary embodiments of the inline injection with flute/VG concept shall be presented below.

Embodiment 1

Figure 5:
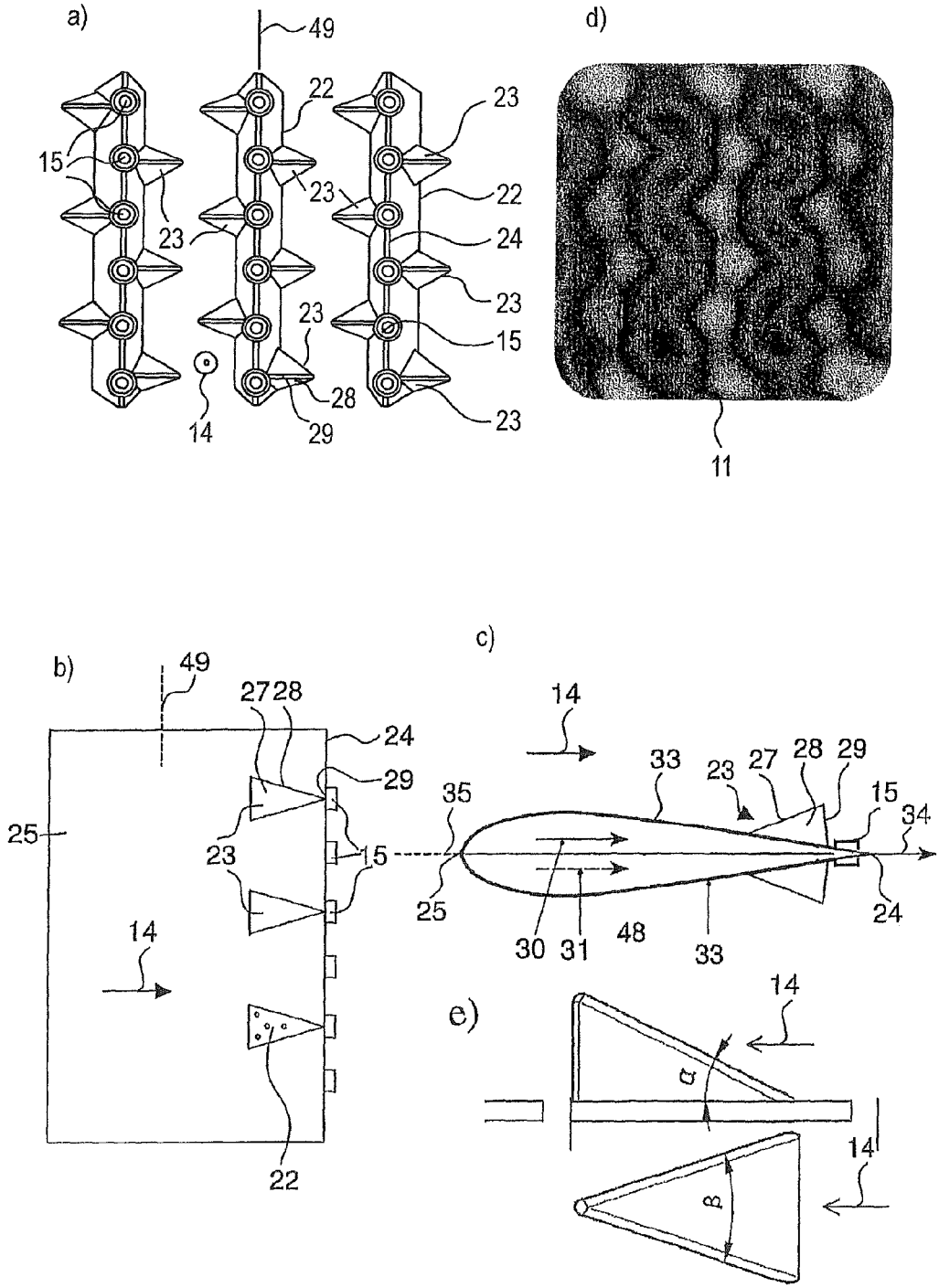
FIG. 5 shows in a) the streamlined body according to an exemplary embodiment of the disclosure in a view opposite to the direction of the flow of oxidising medium with fuel injection parallel to the flow of oxidising medium, in b) a side view onto such a streamlined body, in c) a cut perpendicular to a central plane of the streamlined body in d) the corresponding fuel mast fraction contour at the exit of the burner, in e) a schematic sketch how the attack angle and a sweep angle of the vortex generator can be defined, wherein in an upper representation a side elevation view is given, and in a lower representation a view onto the vortex generator in a direction perpendicular to the plane on which the vortex generator is mounted are given, in f) a perspective view onto a body and its interior structure, and in g) in a cut perpendicular to the longitudinal axis.
Figure 5:
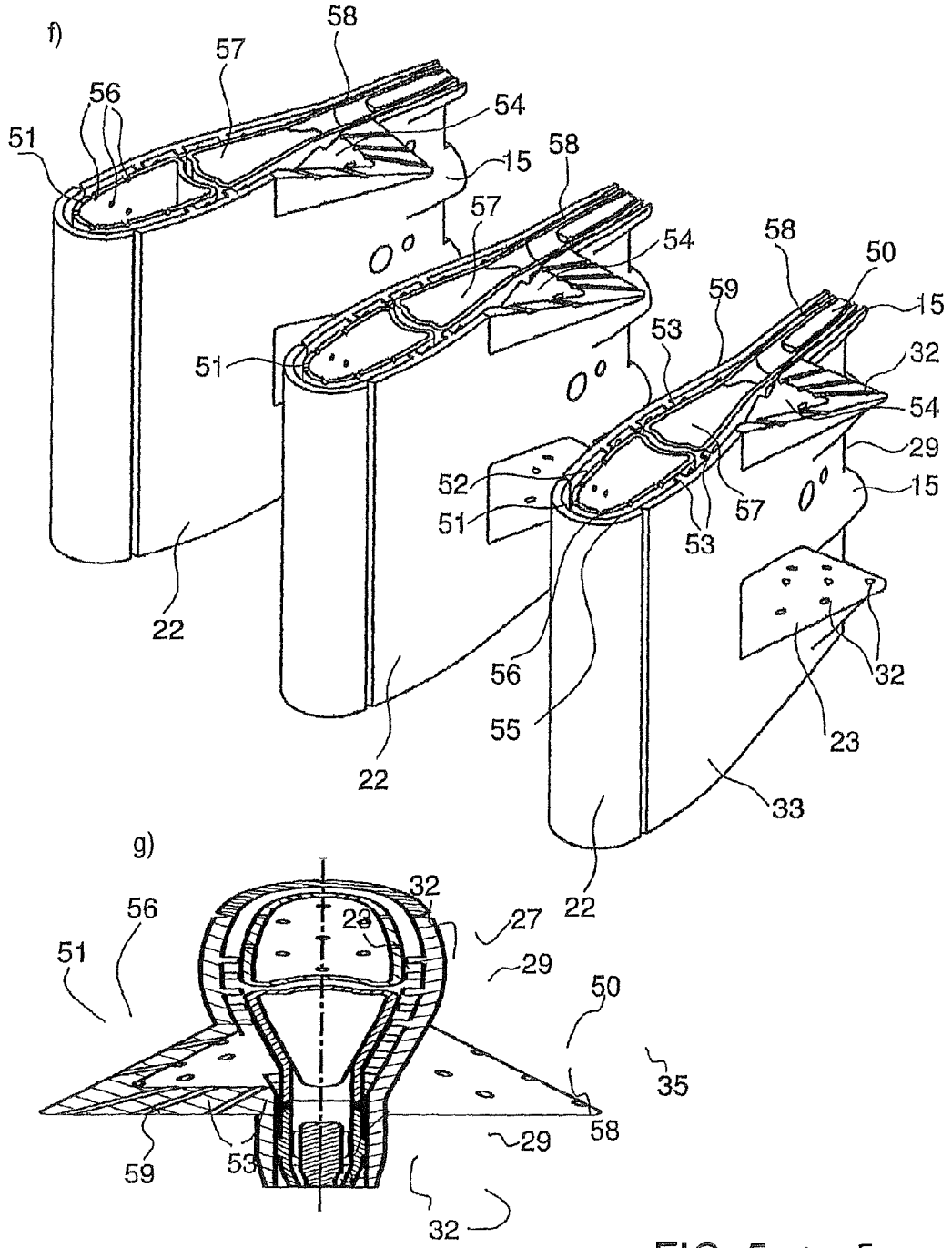

The first exemplary embodiment of the disclosure staggers the vortex generators 23 embedded on the bodies or flutes 22 as shown in FIG. 5. The vortex generators 23 are located sufficiently upstream of the fuel injection location to avoid flow recirculations. The vortex generator attack and sweep angles are chosen to produce highest circulation rates at a minimum pressure drop.

Such vortex generators can have an attack angle $\alpha$ in the range of 15-20° and/or a sweep angle $\beta$ in the range of 55-65°. For a definition of these angles reference is made to FIG. 5*e*), where for an orientation of the vortex generator in the air flow 14 as given in FIG. 5 *a*) the definition of the attack angle $\alpha$ is given in the upper representation which is an elevation view, and the definition of the sweep angle $\beta$ is given in the lower representation, which is a top view onto the vortex generator.

As illustrated the body 22 is defined by two lateral surfaces 33 joined in a smooth round transition at the leading edge 25 and ending at a small radius/sharp angle at the trailing edge 24 defining the cross-sectional profile 48. Upstream of the trailing edge, the vortex generators 23 are located. The vortex generators are of triangular shape with a triangular lateral surface 27 converging with the lateral surface 33 upstream of the vortex generator, and two side surfaces 28 substantially perpendicular to a central plane 35 of the body 22. The two side's surfaces 28 converge at a trailing edge 29 of the vortex generator 23, and this trailing edge can be just upstream of the corresponding nozzle 15.

The lateral surfaces 27 but also the side surfaces 28 can be provided with effusion/film cooling holes 32.

The whole body 22 can be arranged between and bridging opposite the two walls 3 of the combustor, so along a longitudinal axis 49 substantially perpendicular to the walls 3. Parallel to this longitudinal axis there is, according to this embodiment, the leading edge 25 and the trailing edge 24. It is however also possible that the leading edge 25 and/or the trailing edge are not linear but are rounded.

At the trailing edge, the nozzles 15 for fuel injection can be located. In this case fuel injection takes place along the injection direction 35 which is parallel to the central plane 35 of the body 22. Fuel, as well as carrier air, are transported to the nozzles 15 as schematically illustrated by arrows 30 and 31, respectively. The fuel supply can be provided by a central tubing, while the carrier air can be provided in a flow adjacent to the walls 33 to also provide internal cooling of the structures 22. The carrier airflow can also be used for supply of the cooling holes 23. Fuel is injected by generating a central fuel jet along direction 34 enclosed circumferentially by a sleeve of carrier air.

The staggering of vortex generators 23 can help in avoiding merging of vortices resulting in preserving relatively high net longitudinal vorticity. The local conditioning of fuel air mixture with vortex generators close to respective fuel jets can improve the mixing. The overall burner pressure drop can be relatively lower. The respective vortex generators produce counter rotating vortices which at a specified location pick up the axially spreading fuel jet.

Three bodies 22 according to an exemplary embodiment arranged within an annular secondary combustion chamber are given in perspective view in FIG. 5*f*, wherein the bodies are cut perpendicularly to the longitudinal axis 49 to show their interior structure, and in a cut perpendicular to the longitudinal axis in FIG. 5*g*.

In the cavity formed by the outer wall 59 of each body on the trailing side thereof there is located the longitudinal inner fuel tubing 57. It is distanced from the outer wall 59. This distance is maintained by distance keeping elements 53 provided on the inner surface of the outer wall 59.

From this inner fuel tubing 57, the branching off tubing extends towards the trailing edge 29 of the body 22. The outer walls 59 at the position of these branching off tubings is shaped such as to receive and enclose these branching off tubings forming the actual fuel nozzles with orifices located downstream of the trailing edge 29.

In the substantially cylindrically shaped interior of the branching off tubings there is located a cylindrical central element 50 which leads to an annular stream of fuel gas. As between the wall of the branching off tubings and the outer walls 59 at this position there is also a substantially annular interspace. This annular stream of fuel gas at the exit of the nozzle is enclosed by substantially annular carrier gas stream.

Towards the leading edge of the body 22 in the cavity formed by the outer wall 59 of the body in this embodiment there is located a carrier air tubing channel 51 extending substantially parallel to the longitudinal inner fuel tubing channel 57. Between the two channels 57 and 51 there is an interspace 55. The walls of the carrier air tubing channel 51 facing the outer walls 59 of the body 22 run substantially parallel thereto again distanced therefrom by distancing elements 53. In the walls of the carrier air tubing channel 51 there are located cooling holes 56 through which carrier air travelling through channel 51 can penetrate. Air penetrating through these holes 56 impinges onto the inner side of the walls 59 leading to impingement cooling in addition to the convective cooling of the outer walls 59 in this region.

Within the walls 59 there are provided the vortex generators 23 in a manner such that within the vortex, generators cavities 54 are formed, which are fluidly connected to the carrier air feed. From this cavity the effusion/film cooling holes 32 are branching off for the cooling of the vortex generators 23. Depending on the exit point of these holes 32 they can be inclined with respect to the plane of the surface at the point of exit in order to allow efficient film cooling effects.

Embodiment 2

Figure 6:
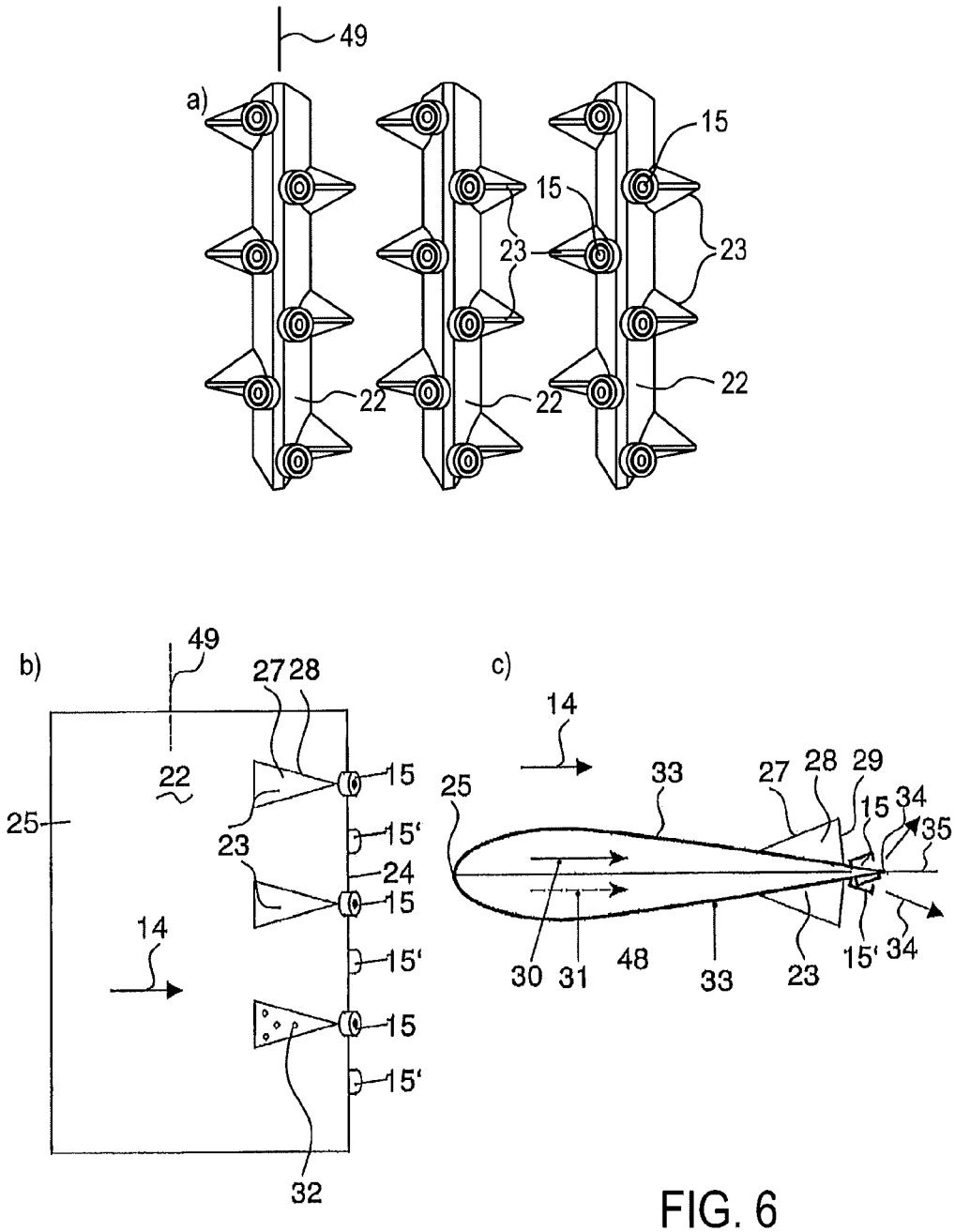
FIG. 6 shows in a) the streamlined body according to an exemplary embodiment of the disclosure in a view opposite to the direction of the flow of oxidising medium with fuel injection inclined to the flow of oxidising medium, in b) a side view onto such a streamlined body, in c) a cut perpendicular to the central plane of the streamlined body.

Another exemplary embodiment of the disclosure as shown below in FIG. 6, is to direct the fuel at a certain angle (for example, up to 90°). In this case, the fuel is directed into the vortices and this has shown to improve mixing even further as shown in FIG. 7.

In this case there are, along the row of nozzles 15, a first set of three nozzles 15, which are directing the fuel jet 34 out of plane 35 at one side of plane 35, and the second set of nozzles 15' directing the corresponding fuel jet out of plane at the other side of plane 35. The more the fuel jets 34 are directed into the vortices the more efficient the mixing takes place.

Embodiment 3

Figure 7:
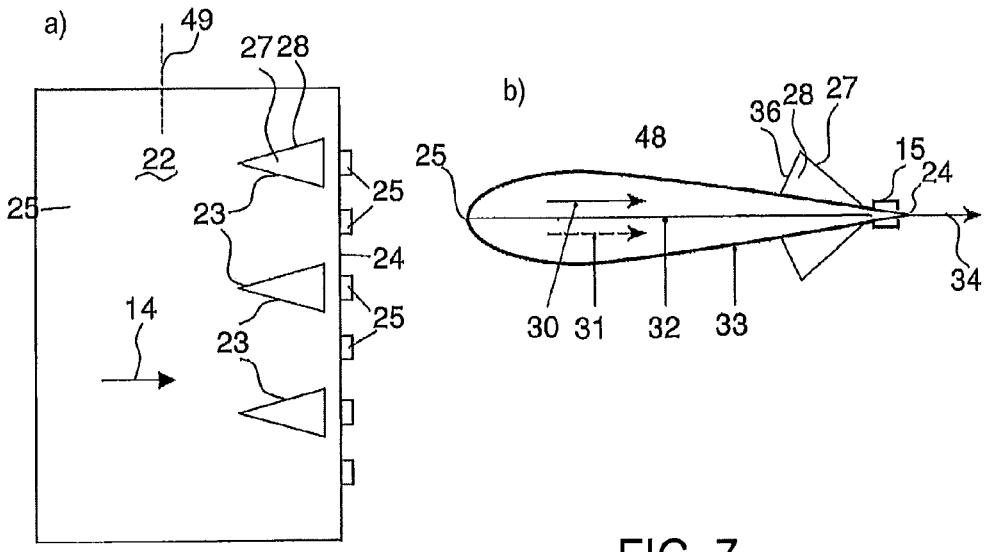
FIG. 7 shows in a) a side view onto a streamlined body according to an exemplary embodiment of the disclosure with inverted vortex generators, in b) a cut perpendicular to the central plane of the streamlined body.

Another exemplary embodiment of the disclosure is to invert the vortex generators (facing upstream) as shown in FIG. 7. This can help in bringing the vortices closer to the fuel injection location without producing adverse flow recirculations. The fuel injection locations can be varied with the vortex generator locations to improve the interaction of vortices with the fuel jet.

Embodiment 4

Another exemplary embodiment of the disclosure can involve providing 2 fuel jets (injected at an angle) per VG. This can improve the mixing further because each fuel jet is conditioned by the surrounding vortex.

Embodiment 5

Another exemplary embodiment of the disclosure can involve increasing the number of flutes 22 and can replace the current outlet guide vanes of the high-pressure turbine. This can provides better mixing and arrest adverse flow variations arising from the high-pressure turbine.

Embodiment 6

Figure 8:
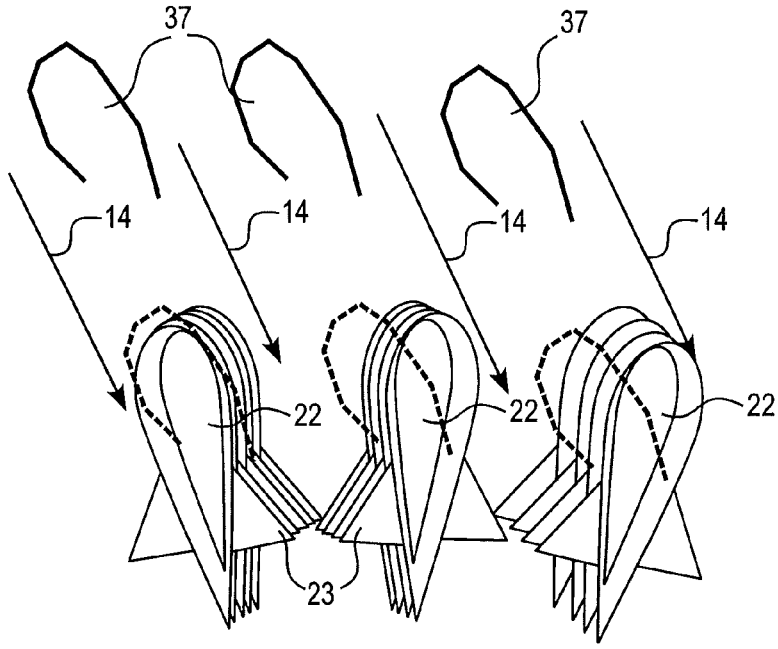
FIG. 8 shows a radial view onto a row of streamlined bodies according to an exemplary embodiment of the disclosure where the central plane of the streamlined bodies is inclined with respect to the flow direction of oxidising medium.

Another exemplary embodiment of the disclosure shown in FIG. 8, involves providing inclined bodies 22 (or high-pressure turbine outlet guide vanes) based on the inlet swirl angle exiting the high-pressure turbine. This can decrease the pressure drop needed to straighten the high-pressure turbine flow. Specifically, the rotating high-pressure turbine blades 37 induce a general flow direction 14 which is not axial and the bodies 22 are at least over a part of their longitudinal length not parallel to this direction 14.

Figure 9:
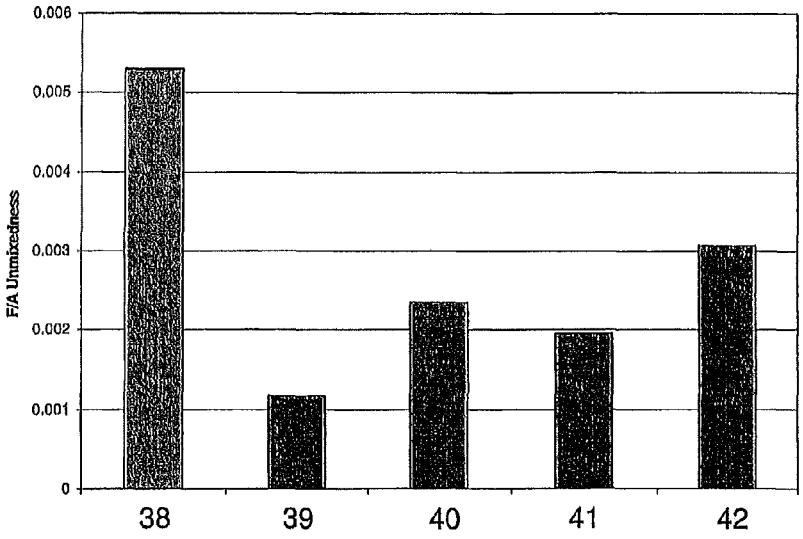
FIG. 9 shows a comparison of unmixedness values for the investigated concepts.
Figure 10:
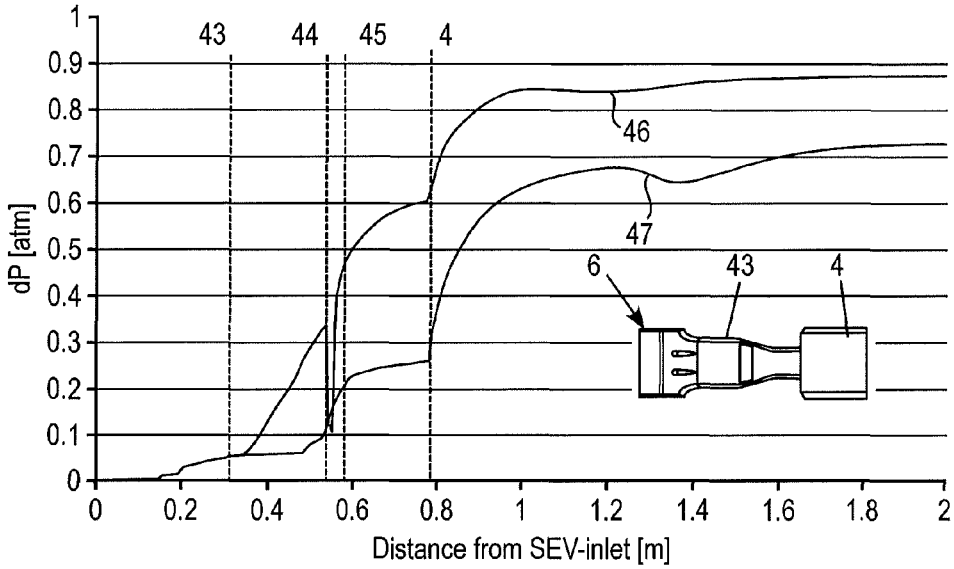
FIG. 10 shows a comparison of burner pressure drop for the setup according to FIG. 2 and the setup according to FIG. 5.
Figure 11:
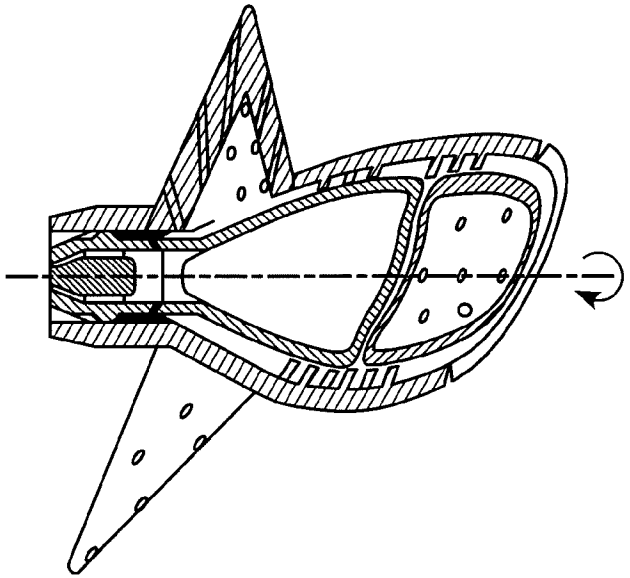
FIG. 11 shows a profile of the streamline body rotated or twisted in opposing directions relative to the longitudinal axis on both side of a longitudinal midpoint, in order to impose a swirl in the main flow.

FIG. 9 is a comparison of unmixedness values for the exemplary embodiments, showing the fuel air mixing performance of several injection examples. The mixing improvement obtained from coflow injection with vortex generators is comparable with best available cross fuel injection lances as given, for example, in FIG. 2. However a disadvantage is the high-pressure loss associated with the fuel injection according to FIG. 2. FIG. 10 is a comparison of burner pressure drop for a setup according to FIG. 2 and exemplary embodiments according to the disclosure showing the burner total pressure drop for the exemplary embodiment of the disclosure and the one according to FIG. 2. The low-pressure drop obtained with the inline injection concept according to the disclosure can be utilized for operating at highly reactive conditions.

In summary, at least the following advantages of the injection concept according to exemplary embodiments of the disclosure when compared with the known concepts can be given.

Inline injection according to exemplary embodiments of the disclosure can offer better mixing performance at very low burner pressure drops:

The mixing performance for the system according to FIG. 2 can be achievable with increased burner pressure drops (see FIGS. 9, 10).

A performance benefit can be achieved due to removal or replacement of high-pressure carrier air with low pressure carrier air.

Savings in the burner pressure drop obtained with the proposed inline injection can allow to burn highly reactive fuels and operating conditions. The known design can pose operational issues at higher SEV inlet temperatures or highly reactive fuels Inline injection can provide better control of fuel residing close to the burner walls when compared to the cross flow injection. This can provide higher flashback margin for the inline injection design.

Reduced burner length can result in reduction in cooling requirements. There is the possibility to replace burner effusion cooling air with TBC coated burner.

There is an opportunity to mitigate thermo acoustic pulsations due to increased fuel-air mixture asymmetry at the burner exit. There is an increased number of vortices when compared to 4 vortices in the known designs.

There can be sufficiently high burner velocities in the entire burner length to avoid flame holding due to fuel/air mixture residing in recirculation regions.

In the inline injection, outlet guide vanes of the high-pressure turbine can act as flow conditioners and fuel injectors instead of outlet guide vanes acting as flow conditioners in the known designs.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

1 burner
2 mixing space, mixing zone
3 burner wall
4 combustion space
5 outlet side, burner exit
6 inlet side
7 injection device, fuel lance
8 main flow from high-pressure turbine
9 flow conditioning, turbine outlet guide vanes
10 vortex generators
11 fuel mass fraction contour at burner exit 5
12 combustion chamber wall
13 transition between 3 and 12
14 flow of oxidising medium
15 fuel nozzle
16 foot of 7
17 shaft of 7
18 converging portion of 3
19 reduced burner cross-sectional area
20 reduction in cross section
21 entrance section of 3
22 streamlined body, flute
23 vortex generator on 22
24 trailing edge of 22
25 leading edge of 22
26 injection direction
27 lateral surface of 23
28 side surface of 23
29 trailing edge of 23
30 fuel gas feed
31 carrier gas feed
32 effusion/film cooling holes
33 lateral surface of 22
34 ejection direction of fuel/carrier gas mixture
35 central plane of 22
36 leading edge of 23
37 high-pressure turbine rotating blade
38 value for the setup according to FIG. 1
39 value for the setup according to FIG. 2
40 value for the setup according to FIG. 5
41 value for the setup according to FIG. 6
42 value for the setup according to FIG. 7
43 position upstream of streamlined body
44 injection for setup according to FIG. 2
45 injection for setup according to FIG. 5
46 pressure curve for setup according to FIG. 2
47 pressure curve for setup according to FIG. 5
48 cross-sectional profile of 22
49 longitudinal axis of 22
50 central element
51 carrier air channel
52 interspace between 37 and 51
53 distance keeping elements
54 cavity within 23
55 interspace between 51 and 36
56 cooling holes
57 inner fuel tubing, longitudinal part
58 branching off tubing of inner fuel tubing
59 outer wall of 22

What is claimed is:

1. A burner for a combustion chamber of a gas turbine, comprising:

an injection device for introducing at least one gaseous fuel into the burner, the injection device comprising:

at least one body arranged in the burner and configured as a streamlined body which has a streamlined cross-sectional profile and which extends with a longitudinal direction perpendicularly or at an inclination to a main flow direction prevailing in the burner and two lateral surfaces;

at least one nozzle for introducing the at least one gaseous fuel into the burner, the at least one nozzle having an outlet orifice at or in a trailing edge of the streamlined body; and at least one vortex generator protruding from one of the at least two lateral surfaces and located upstream of the at least one nozzle and the trailing edge of the streamlined body and downstream of the leading edge of the streamlined body.

2. The burner according to claim 1, comprising:

a mixing zone located downstream of the body, and wherein at and/or downstream of the body the cross-section of the mixing zone is reduced, wherein this reduction is at least 10%, compared to the flow cross-section upstream of the body.

3. The burner according to claim 1, wherein the vortex generator has at least one of an attack angle in the range of 15-20° and a sweep angle in the range of 45-75°.

4. The burner according to claim 1, comprising:

at least two nozzles arranged at different positions along the trailing edge;

at least one vortex generator located upstream of each of these nozzles; and vortex generators of adjacent nozzles are located only at opposite lateral surfaces.

5. The burner according to claim 1, comprising:

at least one nozzle for injecting fuel and/or carrier gas substantially parallel to the main flow direction.

6. The burner according to claim 1, comprising:

at least one nozzle for injecting fuel and/or carrier gas at an inclination angle between 0-30° with respect to the main flow direction.

7. The burner according to claim 1, comprising:

at least two nozzles located downstream of each vortex generator.

8. The burner according to claim 1, wherein the streamlined body extends across an entire flow cross section between opposite walls of the burner, wherein the burner is an annular burner arranged circumferentially with respect to a turbine axis, and wherein between 10-100 streamlined bodies, are arranged around the circumference.

9. The burner as claimed in claim 1, wherein the profile of the streamlined body is inclined with respect to the main flow direction at least over a part of its longitudinal extension for imposing a swirl on the main flow.

10. The burner according to claim 1, comprising:

cooling elements for the vortex generator wherein the cooling elements are film cooling holes provided in at least one of the surfaces of the vortex generator.

11. The burner according to claim 1, comprising:

cooling elements provided for the body, wherein the cooling elements are at least one of internal circulation of cooling medium along sidewalls of the body and film cooling holes, located near the trailing edge.

12. The burner according to claim 1, wherein upstream of the body and downstream of a last row of rotating blades of the gas turbine there are no additional vortex generators, and no additional flow conditioning elements.

13. The burner according to claim 2, wherein the fuel is injected from the nozzle together with a carrier gas stream, and wherein the carrier gas air is low pressure air with a pressure in a range of 10-25 bar.

14. The burner as claimed in claim 1, the streamlined body comprising:

a cross-sectional profile which is mirror symmetric with respect to the central plane of the body.

15. The burner according to claim 1, in combination with a turbine combustion chamber configured for the combustion of MBtu fuel.

16. The burner according to claim 4, comprising:

at least four nozzles arranged along the trailing edge and vortex generators are alternatingly located at the two lateral surfaces.

17. The burner according claim 8, wherein the streamlined bodies are equally distributed along the circumference.

18. The burner as claimed in claim 9, wherein the profile of the streamlined body is rotated or twisted in opposing directions relative to the longitudinal axis on both sides of a longitudinal midpoint, in order to impose a swirl on the main flow.

19. The burner according to claim 10, wherein the film cooling holes are fed with air from a carrier gas feed also used for the fuel injection.

20. The burner according to claim 11, wherein the cooling elements are fed with air from a carrier gas feed also used for the fuel injection.

* * * * *